US008206097B2

(12) United States Patent
Nagai et al.

(10) Patent No.: US 8,206,097 B2
(45) Date of Patent: Jun. 26, 2012

(54) COMPRESSOR

(75) Inventors: Naonori Nagai, Takasago (JP); Kenji Sato, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 547 days.

(21) Appl. No.: 12/447,985

(22) PCT Filed: Dec. 20, 2007

(86) PCT No.: PCT/JP2007/074575

§ 371 (c)(1),
(2), (4) Date: Apr. 30, 2009

(87) PCT Pub. No.: WO2008/075747

PCT Pub. Date: Jun. 26, 2008

(65) Prior Publication Data

US 2010/0068044 A1 Mar. 18, 2010

(30) Foreign Application Priority Data

Dec. 21, 2006 (JP) ..... 2006-343814

(51) Int. Cl.
*F04D 29/44* (2006.01)
*F04D 29/54* (2006.01)

(52) U.S. Cl. ..... 415/195; 415/220

(58) Field of Classification Search ..... 415/119, 415/174.5, 173.5, 194, 195, 230, 191, 211.2, 415/220; 416/203

See application file for complete search history.

(56) References Cited

U.S. PATENT DOCUMENTS

| | | | | |
|---|---|---|---|---|
| 3,116,789 | A * | 1/1964 | Nelson | 165/147 |
| 4,253,800 | A * | 3/1981 | Segawa et al. | 416/203 |
| 6,139,275 | A * | 10/2000 | Noda et al. | 416/203 |
| 6,439,838 | B1 * | 8/2002 | Crall et al. | 415/119 |
| 2004/0047722 | A1 * | 3/2004 | Chen et al. | 415/1 |
| 2006/0277912 | A1 | 12/2006 | Shibata | |

FOREIGN PATENT DOCUMENTS

| | | | |
|---|---|---|---|
| JP | 49-24005 | B1 | 6/1974 |
| JP | 57-176400 | A | 10/1982 |
| JP | 6-146922 | A | 5/1994 |
| JP | 7-17994 | U | 3/1995 |
| JP | 2000-145699 | A | 5/2000 |
| JP | 2006-37877 | A | 2/2006 |

OTHER PUBLICATIONS

International Search Report of PCT/JP2007/074575, date of mailing Mar. 11, 2008.

* cited by examiner

*Primary Examiner* — S. V Clark

(74) *Attorney, Agent, or Firm* — Westerman, Hattori, Daniels & Adrian, LLP

(57) ABSTRACT

A compressor which includes: an inner casing arranged so as to cover a rotor shaft; an outer casing arranged so as to cover the inner casing and forming a fluid flow path around the rotor shaft; and a plurality of struts mounted in the entrance of the fluid flow path and between the inner casing and the outer casing; in which the plurality of struts are arranged in a radial pattern centered on the rotor shaft, and the spacings between the adjacent struts in the circumferential direction of the rotor shaft are unequal.

13 Claims, 12 Drawing Sheets

COMPRESSOR

TECHNICAL FIELD

The present invention relates to a compressor that compresses air.

Priority is claimed on Japanese Patent Application No. 2006-343814, filed Dec. 21, 2006, the content of which is incorporated herein by reference.

BACKGROUND ART

Conventionally, combustion gas for rotating a turbine in a gas turbine is generated by a combustor combusting fuel gas with compressed air that is compressed with a compressor. An intake duct that draws in air from the open air is installed at the inlet of the compressor that generates this compressed air. As shown in the cross-sectional view of FIG. 11, an intake duct 100 is formed to have a single suction structure with the upper side being opened so as to draw in the open air along with having a ring shape at the periphery of a rotor shaft 5 at the distal end of the rotor shaft 5 at which a rotor blade 12 of a compressor 101 is installed.

In the intake duct 100, an intake casing 100*a* on the side of the rotor shaft 5 connects with an inner casing 101*a* that covers the periphery of the rotor shaft 5, and an outer side intake casing 100*b* connects with an outer casing 101*b* that is disposed on the outer periphery of the inner casing 101*a*. Note that an annular space that is enclosed by the inner casing 101*a* and the outer casing 101*b* serves as an air flow path 101*c*, and a stator blade 11 and the rotor blade 12 are alternately arranged. Then, air that has been drawn in through the intake duct 100 is compressed by rotation of the rotor blade 12 via the rotor shaft 5.

In the case of a single suction structure that draws in air from a direction perpendicular to the rotor shaft as in the intake duct 100 shown in FIG. 11, in the annular space 102 that is constituted by the intake casings 100*a*, 100*b*, the inner casing 101*a*, and the outer casing 101*b*, the air that is drawn in from the circumferential direction of the rotor shaft 5 is distributed in the circumferential direction of the annular flow path. Then, that air that has been distributed in the circumferential direction in this annular space 102 flows into an air flow path 101*c* that is constituted by the inner casing 101*a* and the outer casing 101*b*. In this way, when flowing from the space 102 into the air flow path 101*c*, in order to make that flow smooth, a bell mouth shape is formed in which the distal end of the intake casing 100*b* and the outer casing 101*b* are curved in the outer peripheral direction, and this curved portion 101*d* is swelled toward the inner wall of the intake casing 100*a*. The intake casing 100*b* is connected to the distal end of the curved portion 101*d* of the outer casing 101*b*.

In this way, the intake duct 100 is constituted by the intake casings 100*a*, 100*b*, the inner casing 101*a*, and the outer casing 101*b*, but the inner casing 101*a* is constituted by being extended further toward the distal end of the rotor shaft 5 than the outer casing 101*b*. And, in order to support the inner casing 101*a* and the outer casing 101*b*, a plurality of struts 103 are provided in a radial pattern centered on the rotor shaft 5. Conventionally, these plurality of struts 103 have always been disposed at an equal spacings with respect to the circumferential direction of the rotor shaft 5 as shown in FIG. 12 (refer to Patent Document 1).

Patent Document 1: Japanese Unexamined Utility Model Application, First Publication No. H07-17994 (page 4 and FIG. 4 and FIG. 5)

DISCLOSURE OF THE INVENTION

Problem to be Solved by the Invention

In the case of the intake duct 100 being constituted as shown in FIG. 11, it is constituted as the single suction structure that draws in open air from a direction perpendicular to the rotor shaft 5. Accordingly, since the air that is distributed in the circumferential direction of the rotor shaft 5 in the annular space 102 does not have a balanced flow rate with respect to the flow path area in the circumferential direction, a drift in the circumferential direction exists in the flow of that air.

Therefore, when air flows into the air flow path 101*c* of the compressor 101, a condition of un-uniform inflow in the circumferential direction arises, which may cause a decline in the stall margin as well as lead to a rotating stall during starting and velocity increasing of the compressor 101. Moreover, since the inflow condition of air into the air flow path 101*c* of the compressor 101 is un-uniform in the circumferential direction, locations arise in which the angle of elevation with respect to the struts 103 becomes large. As a result, at the places where the angle of attack is large, a separation at the struts 103 arises, and the profile loss increases.

Also, as shown in FIG. 11, forming the curved portion 101*d* near the connection portion between the intake casing 100*b* and the outer casing 101*b* into a smooth bell mouth shape accelerates the flow of air that flows along the wall surface formed by the intake casing 100*b* and the outer casing 101*b*. As a result, the flow that flows into the struts 103 has a three-dimensional drift that is distributed in the span direction as well. In particular, in the strut periphery, the profile loss increases at locations where the flow of air becomes fast. This is because the profile loss is proportional to the square of the velocity.

Furthermore, as shown in FIG. 12, in the case of providing struts 103 at an equal spacings with respect to the circumferential direction of the rotor shaft 5, based on the influence of the wake (region of slow flow velocity) that occurs at the rear end of the struts 103, the harmonic component of the exciting force that corresponds to the number of struts 103 becomes large. For that reason, when designing the stator blade 11 and the rotor blade 12 of the compressor 101, it is necessary to produce a detuned design that does not resonate with the harmonic component due to the struts 103.

In this way, due to the arrangement relation between the single suction structure of an intake duct and the struts, the inflow condition of air that is drawn into the compressor becomes un-uniform, and the pressure loss due to the struts increases, leading to a drop in the compressor efficiency. Also, the degree of freedom in the blade design of the compressor is also restricted by the harmonic component of the exciting force that is generated by arranging the struts in equal spacings in the circumferential direction.

The present invention was achieved in view of the above circumstances, and has as its object to provide a compressor having a high degree of freedom of blade design and having a high compression efficiency.

Means for Solving the Problem

In order achieve the aforementioned object, an intake duct of a compressor of the present invention consists of an inner casing arranged so as to cover a rotor shaft; an outer casing arranged so as to cover the inner casing and forming a fluid flow path around the rotor shaft; and a plurality of struts mounted in the entrance of the fluid flow path and between the inner casing and the outer casing, in which the plurality of struts are arranged in a radial pattern centered on the rotor shaft, and spacings between the adjacent struts in the circumferential direction of the rotor shaft are unequal.

In the intake duct of the compressor of the present invention, n struts may be arranged in the circumferential direction of the rotor shaft (n being an integer of 2 or more) and the difference between the maximum value and the minimum value of the angle expressing the spacings of the adjacent struts when centered on the rotor shaft may be at least 120 degrees/n.

The intake duct of the compressor of the present invention may be further provided with a first casing that is connected to the inner casing at the entrance end of the fluid flow path, and a second casing that is connected to the outer casing at the entrance end of the fluid flow path; in which a curved portion that curves so as to project toward the first casing may be formed at the connection portion of the outer casing with the second casing.

In the intake duct of the compressor of the present invention, the curved portion may have: a flat portion that is adjacent to the second casing and consists of a surface that is approximately parallel with the peripheral surface of the rotor shaft; and a curved surface that smoothly curves inward in the radial direction of the rotor shaft from the distal end of the flat portion, in which a cross-section of the curved portion may form an approximate U-shape that projects toward the first casing.

In the intake duct of the compressor of the present invention, the connection portions of the struts with the outer casing may be positioned further to the downstream in the axial direction of the rotor shaft than the distal end of the curved portion.

In the intake duct of the compressor of the present invention, in the flat portion that is formed in an annular shape along the circumferential direction of the rotor shaft, the length in the axial direction of a portion adjacent to an open air suction port that is formed at the distal end of the first casing and the second casing may be longer than the length in the axial direction of another portion that is positioned further from the suction port than the portion.

In the intake duct of the compressor of the present invention, in the curved portion that is formed in an annular shape along the circumferential direction of the rotor shaft, the distal end of a portion that is adjacent to an open air suction port that is formed at the distal end of the first casing and the second casing may project further toward the first casing than the distal end of another portion that is positioned further from the suction port than the portion.

In the intake duct of the compressor of the present invention, the connection portions of the struts with the outer casing may be positioned further downstream in the axial direction of the rotor shaft than the connection portions of the struts with the inner casing.

In the intake duct of the compressor of the present invention, the distance in the axial direction of the connection portion between the struts with the outer casing and the distance in the axial direction of the connection portion between the struts with the inner casing may be longer the closer the struts are to the suction port.

Effect of the Invention

According to the present invention, for the struts that are arranged in a radial pattern centered on the rotor shaft, the spacings between the struts in the circumferential direction of the rotor shaft are unequal. Accordingly, it is possible to reduce the harmonic component that occurs in the case of the struts being arranged at equal spacings as before. That is, within the compressor, it is possible to distribute the exciting force at each frequency in a frequency distribution of fluids that flow to the downstream of the struts. By doing so, since it is possible to reduce the harmonic component that has occurred in a conventional shape, it is possible to increase the degree of freedom of blade design in the compressor.

Also, by providing the flat portion that consists of a surface that is approximately parallel with the peripheral surface of the rotor shaft at the curved portion in the connection portion of the second casing and the outer casing, it is possible to stop the flow of fluid that flows from the periphery of the inner wall of the second casing. Thereby, it is possible to flow the fluid in the circumferential direction of the rotor shaft along this flat portion, and it is possible to make the flow of the fluid that flows from the distal end of the curved portion nearly the same condition in the circumferential direction of the rotor shaft. Thereby it is possible to reduce drifts in flow supplied to the compressor and possible to suppress a drop in efficiency of the compressor.

Furthermore, as a result of the connection position of the struts with the outer casing becoming a removed position with respect to the connection portion of the second casing and the outer casing, it is possible to make the flow of fluid that flows into periphery in the radial direction of the rotor shaft with respect to the struts more uniform. Thereby, since it is possible to reduce the pressure loss at the periphery with respect to the radial direction of the rotor shaft in the struts, it is possible to suppress a drop in efficiency of the compressor.

BRIEF DESCRIPTION OF THE REFERENCE NUMERALS

1 compressor; 2 combustor; 3 turbine; 4*a* inner casing; 4*b* outer casing; 5 rotor shaft; 6*a* intake casing (first casing); 6*b* intake casing (second casing); 7 suction port; 8 strut

Best Mode for Carrying out the Invention (Constitution of Gas Turbine)

Figure 1:
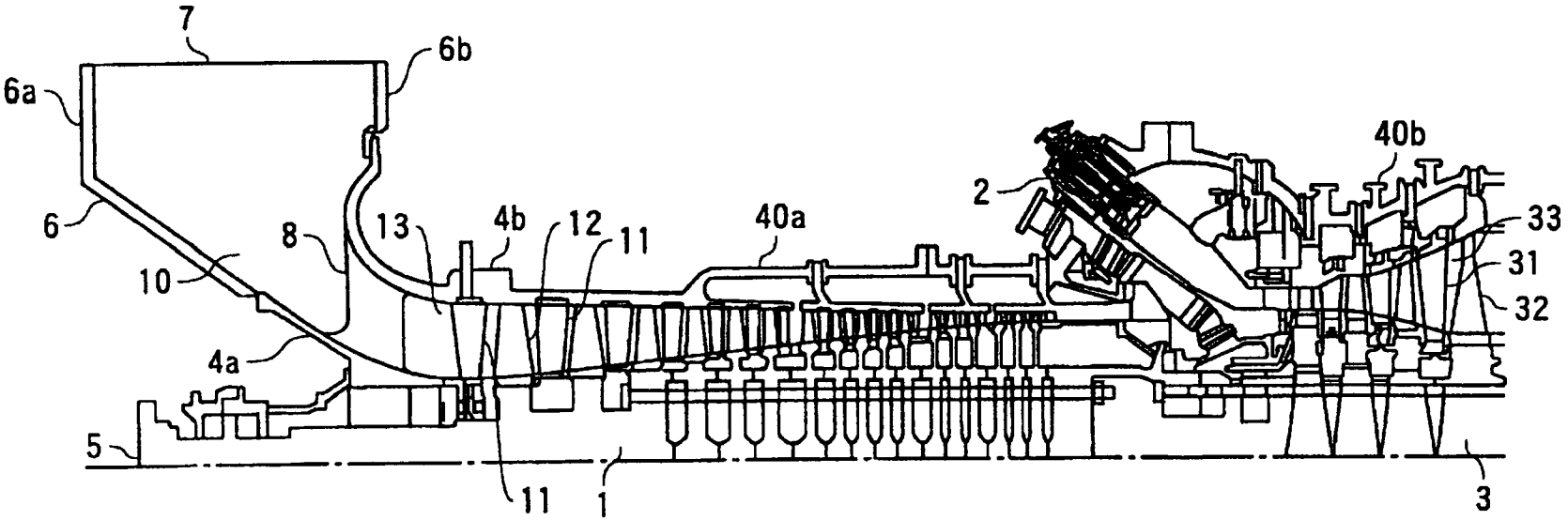
FIG. 1 is an outline sectional view that shows a constitution of a gas turbine provided with an intake duct of the present invention.

The basic constitution of a gas turbine provided with an intake duct of the present invention shall be simply described with reference to FIG. 1. FIG. 1 is an outline sectional view that shows the constitution of the gas turbine.

As shown in FIG. 1, the gas turbine 1 is provided with a compressor 1 that compresses air, a combustor 2 that performs a combustion operation with air that is compressed by the compressor 1 and a fuel being supplied, and a turbine 3 that is rotationally driven by combustion gas from the combustor 2. The compressor 1 and the turbine 3 are respectively covered by the cabins 40*a*, 40*b*, and a plurality of the combustors 2 are provided at equal spacings on the periphery of a rotor shaft 5 that makes the compressor 1 and the turbine 3 a single axis.

Moreover, an intake duct 6 of a single suction structure that is provided with a suction port 7 for drawing in air, to be supplied to the compressor 1 from the open air, in a direction perpendicular to the rotor shaft 5 (the radial direction of the rotor shaft 5) is arranged in the upstream of the compressor 1. The cabin 40*a* is constituted by an inner casing 4*a* and an outer casing 4*b* that are respectively formed on the inner side and the outer side with respect to the radial direction of the rotor shaft 5. Also, this intake duct 6 is constituted by an intake casing (first casing) 6*a* and an intake casing (second casing) 6*b* that are respectively connected to the inner casing 4*a* and an outer casing 4*b*.

That is, the intake duct 6 has a structure that is provided with an annular space 10 by the intake casings 6*a*, 6*b* of a concentric annular shape, and the open air is supplied from the suction port 7 that is open in the radial direction of the rotor shaft 5 in the space that is formed by the intake casings 6*a*, 6*b*. Note that as shown in FIG. 1, each of the following embodiments shall be described assuming the suction port 7 is provided at the upside, but the suction port 7 is not limited to the upside, but may be open in any radial direction of the rotor shaft 5. Similarly, the cabin 40*a* has a double pipe structure by the inner casing 4*a* and the outer casing 4*b* of concentric cylinder shape, and a compressed air flow path 13 is constituted in the space between the inner casing 4*a* and the outer casing 4*b*.

Also, a strut 8 for supporting the inner casing 4*a* and the outer casing 4*b* is provided at an inlet side of the compressor 1. That is, the strut 8 is provided at a stage prior to a stator blade 11 of the first stage that is an IGV (inlet guide vane) of the compressor 1. Note that the first stage stator blade 11 that serves as the IGV is a movable blade that can be opened and closed, and it is possible to set a flow rate that is supplied to the compressor 1 from the intake duct 6 with this first stage stator blade 11.

The stator blade 11 that is fixed to the outer casing 4*b* and the rotor blade 12 that is fixed to the rotor shaft 5 are alternately arranged in the compressed air flow path 13, and air from open air that is draw in by the intake duct 6 is supplied. Also, a stator blade 31 that is fixed to the turbine cabin 40*b* and a rotor blade 32 that is fixed to the rotor shaft 5 are alternately arranged in a turbine flow path 33, and combustion gas that is produced by the combustor 2 is supplied.

In this gas turbine, the air that is compressed by the compressor 1 is supplied to the combustor 2. Then, the compressed air that is supplied to the combustor 2 is used in the combustion of the fuel that is supplied to the combustor 2. A portion of the compressed air is used for cooling of the stator blade 31 that is fixed to the turbine cabin 40*b* and the rotor blade 32 that is fixed to the rotor shaft 5, which are exposed to high temperature by the combustion gas from the combustor 2.

Then, the combustion gas that is generated by the combustion operation in the combustor 2 is supplied to the turbine 3, and the turbine 3 is rotationally driven by the combustion gas alternately passing the rotor blade 32 and the stator blade 31. The compressor 1 is thus rotationally driven by the rotational driving of the turbine 3 being transmitted to the compressor 1 via the rotor shaft 5. Thereby, in the compressor 1, by the rotation of the rotor blade 12 that is fixed to the rotor shaft 5, air that flows in the space that is formed by the stator blade 11 that is fixed to the cabin 40*a* and the rotor blade 12 is compressed.

Embodiments of the compressor 1 of the gas turbine 3 constituted in this way shall be described below.

(First Embodiment)

Figure 2:
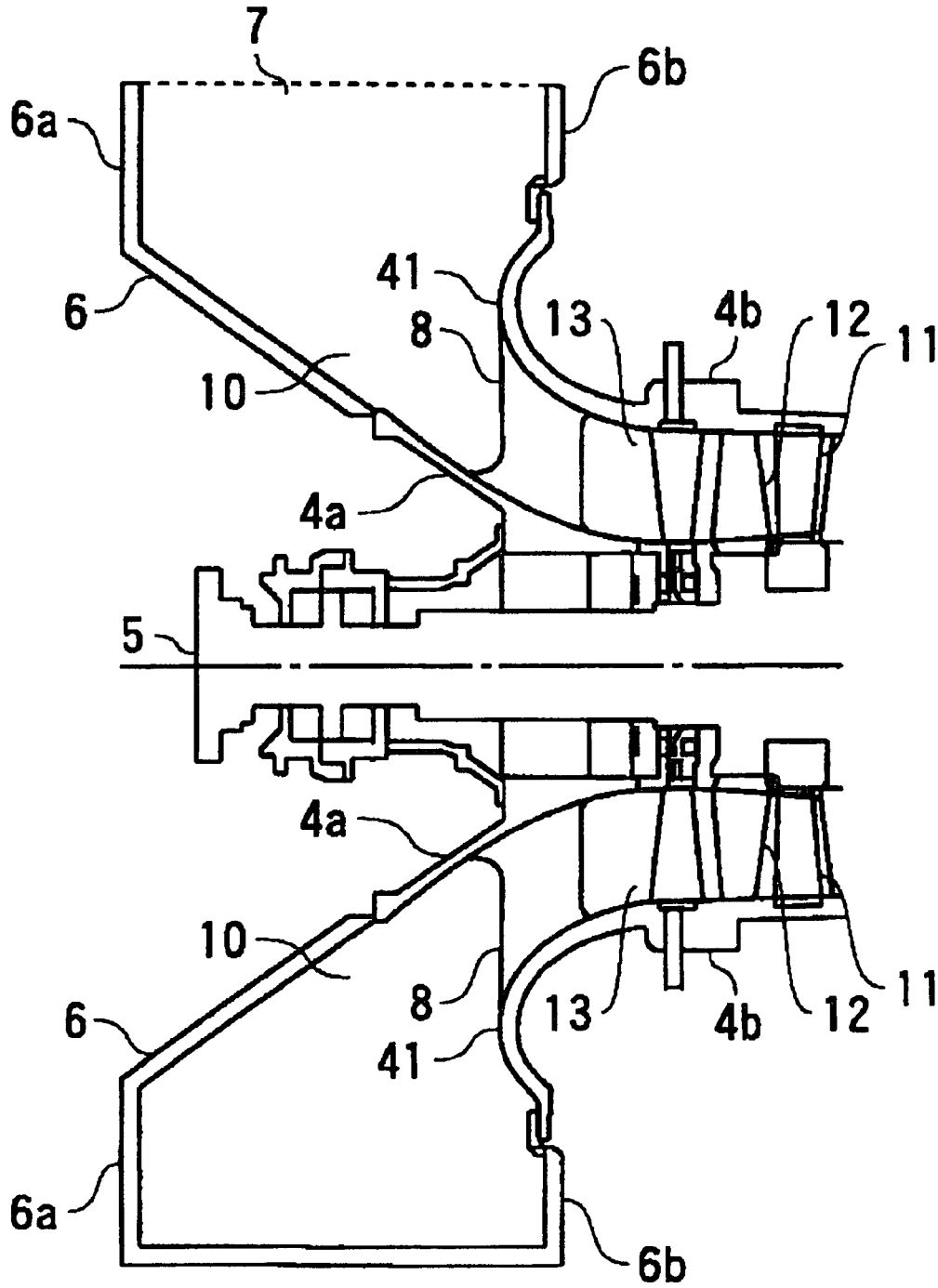
FIG. 2 is an outline sectional view around an intake duct showing a constitution of an intake duct of a first embodiment.
Figure 3:
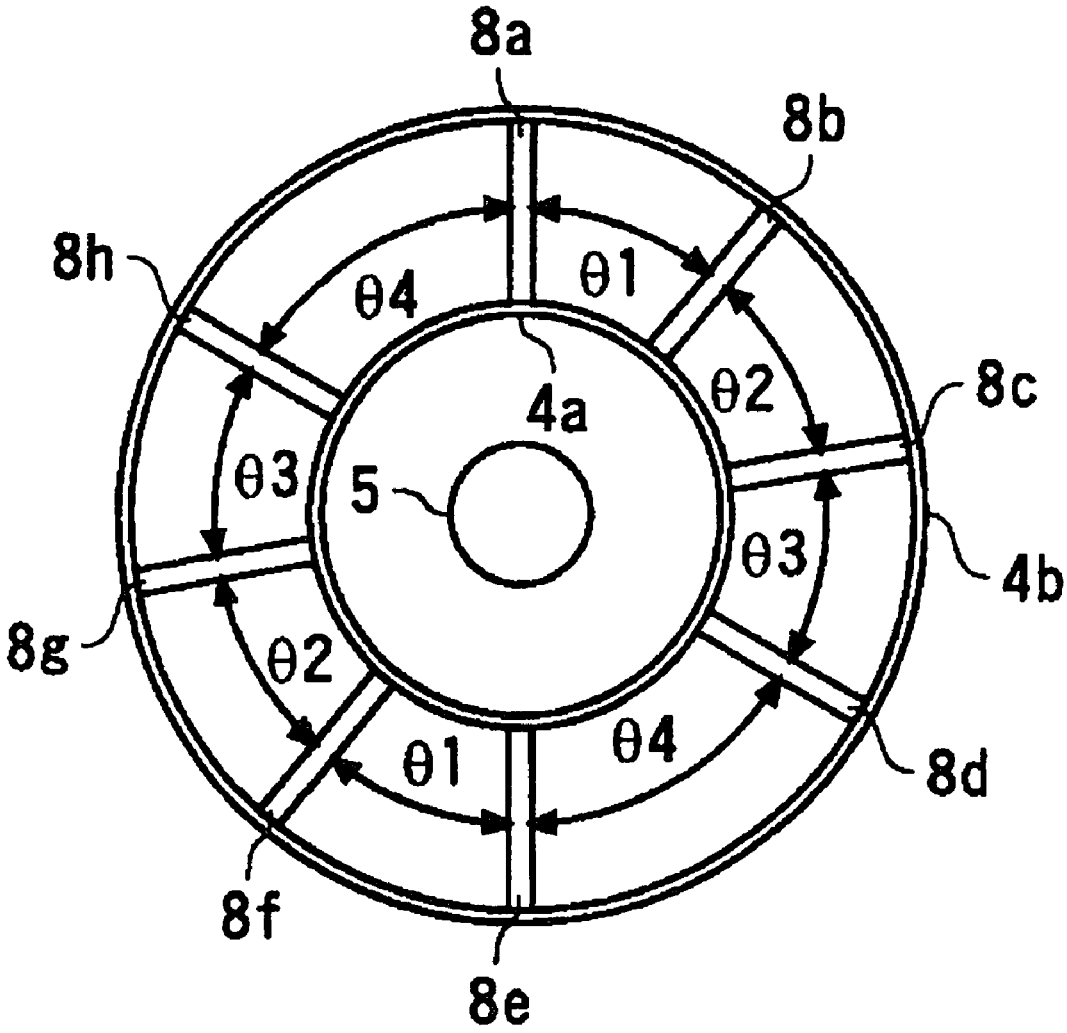
FIG. 3 shows an arrangement relationship of struts in the intake duct of the first embodiment.

The first embodiment of the compressor of the present invention shall be described with reference to the drawings. FIG. 2 is an outline sectional view that shows the constitution around the intake duct of the compressor of the present embodiment. FIG. 3 is a drawing that shows the arrangement relationship of the struts, which are used in the compressor of the present invention, in the circumferential direction of the rotor shaft.

As shown in FIG. 2, the inner casing 4*a* extends until the distal end of the rotor shaft 5, with the distal end thereof having a bent structure toward the peripheral direction, and the annular intake casing 6*a* is connected to this bent distal end. Also, the outer casing 4*b* is curved closer to the side of the compressor 1 than the inner casing 4*a*, with a curved portion 41 having a bell mouth structure that is swollen toward the inside wall of the intake casing 6*a*. The respective side surfaces of the intake casings 6*a*, 6*b* are connected, and the intake duct 6 is formed provided with the annular space 10 by the intake casings 6*a*, 6*b*, the inner casing 4*a*, and the outer casing 4*b*. The suction port 7 for drawing in open air from the upside is formed by forming the upside of this intake duct 6 open.

Furthermore, the struts 8 that are provided in a radial pattern centered on the rotor shaft 5 are connected to the inner side of the curved portion 41 of the outer casing 4*b* as well as the inner casing 4*a*. With these struts 8, the inner casing 4*a* and the outer casing 4*b* are supported at the inlet of the compressor 1. Also, the respective connection positions of the struts 8 with the inner casing 4*a* and the outer casing 4*b* are mostly in agreement in the axial direction of the rotor shaft 5.

When constituted in this manner, FIG. 3 shows the arrangement relationship with respect to the circumferential direction of the rotor shaft 5 for the struts 8 that are installed in a radial pattern with respect to the rotor shaft 5. That is, when eight struts 8*a* to 8*h* are arranged in the circumferential direction of the rotor shaft 5, the difference between the minimum value and the maximum value of the angle of the spacings between adjacent struts among the struts 8*a* to 8*h* is at least 120 degrees/8=15 degrees. Note that in the case of n struts 8, the difference between the minimum value and the maximum value of the angle of the spacings between the adjacent struts 8 is set so as to be at least 120 degrees/n.

In the case of the eight struts 8*a* to 8*h* being arranged as shown in FIG. 3, the spacing of struts 8*a*, 8*b* and struts 8*e*, 8*f* is angle θ1, the spacing of struts 8*b*, 8*c* and struts 8*f*, 8*g* is angle θ2, the spacing of struts 8*c*, 8*d* and struts 8*g*, 8*h* is angle θ3, and the spacing of struts 8*d*, 8*e* and struts 8*h*, 8*a* is angle θ4. At this time, for example, as shown in FIG. 3, the angles θ1 to θ3 are 40 degrees, and the angle θ4 is 60 degrees, so that the difference between the value of angle θ min that is the minimum value in angles θ1 to θ4 and the value of angle θ max the maximum value is set to at least 15 degrees.

Figure 4:
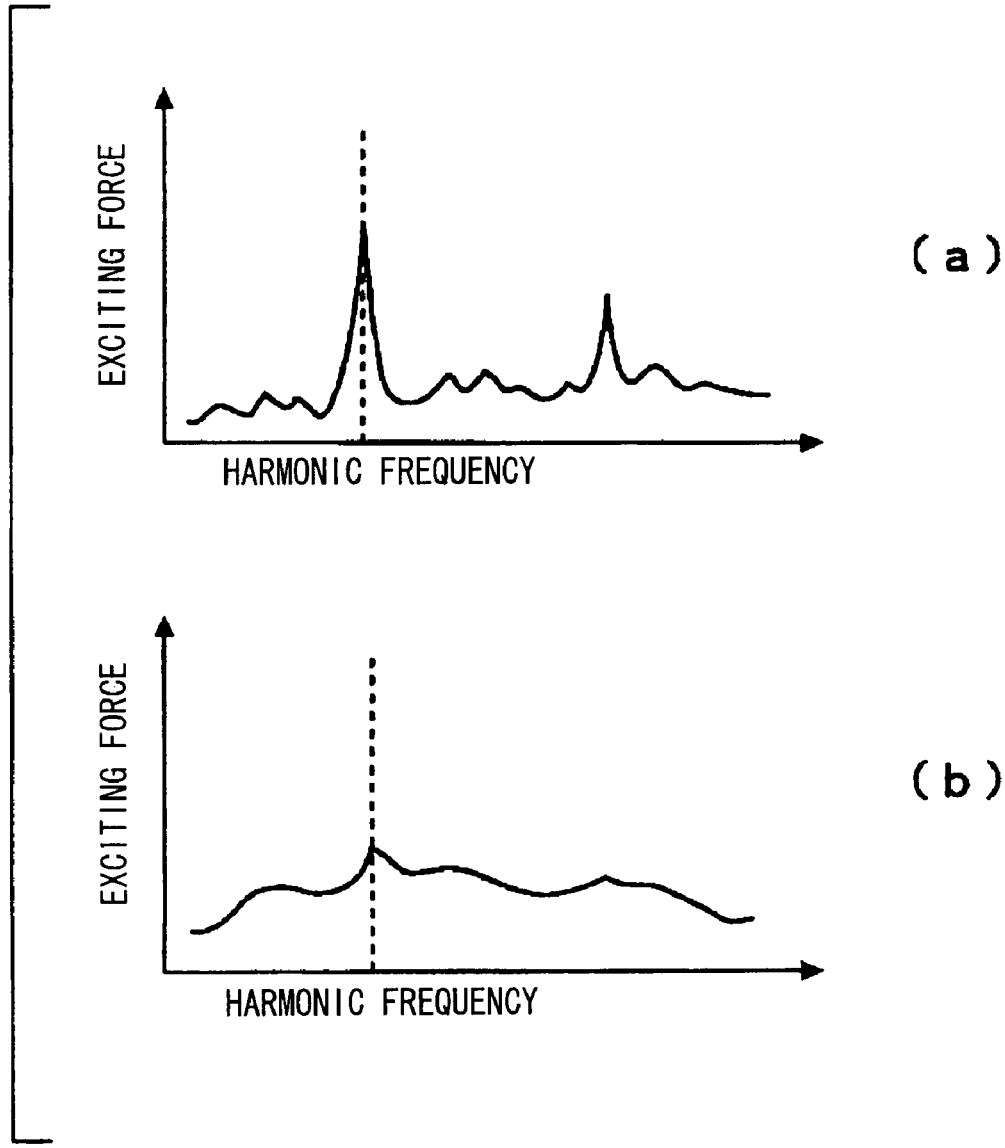
FIG. 4 shows the distribution characteristics of the frequency component in the case of the struts being disposed at equal spacings and in the case of being disposed at unequal spacings.

In this way, by setting the difference between the minimum value and the maximum value of the angle of the spacings of the struts 8 to be at least 120 degrees/n, it is possible to make the distribution of the frequency component of total pressure in downstream of the struts 8 in the compressor flow path 13 have the distribution characteristics shown in (b) of FIG. 4. That is, in the distribution characteristics as shown in (a) of FIG. 4 in which the angles of the spacings of the struts 8 are all made equal, since there is a harmonic component that corresponds to the number of struts, the exciting force in the frequency that becomes the harmonic component becomes outstandingly large. In contrast, in the present embodiment, as shown in (b) of FIG. 4, since the struts 8 are arranged at unequal spacings in the circumferential direction, by distributing the exciting force at each frequency, it is possible to reduce the harmonic component. Note that FIG. 4 expressed by the exciting force the frequency distribution of the total pressure of the air that flows into the downstream of the struts 8, that is, shows the frequency distribution of variance amplitudes of the total pressure of the flow downstream of the struts and upstream of the IGV.

Figure 5:
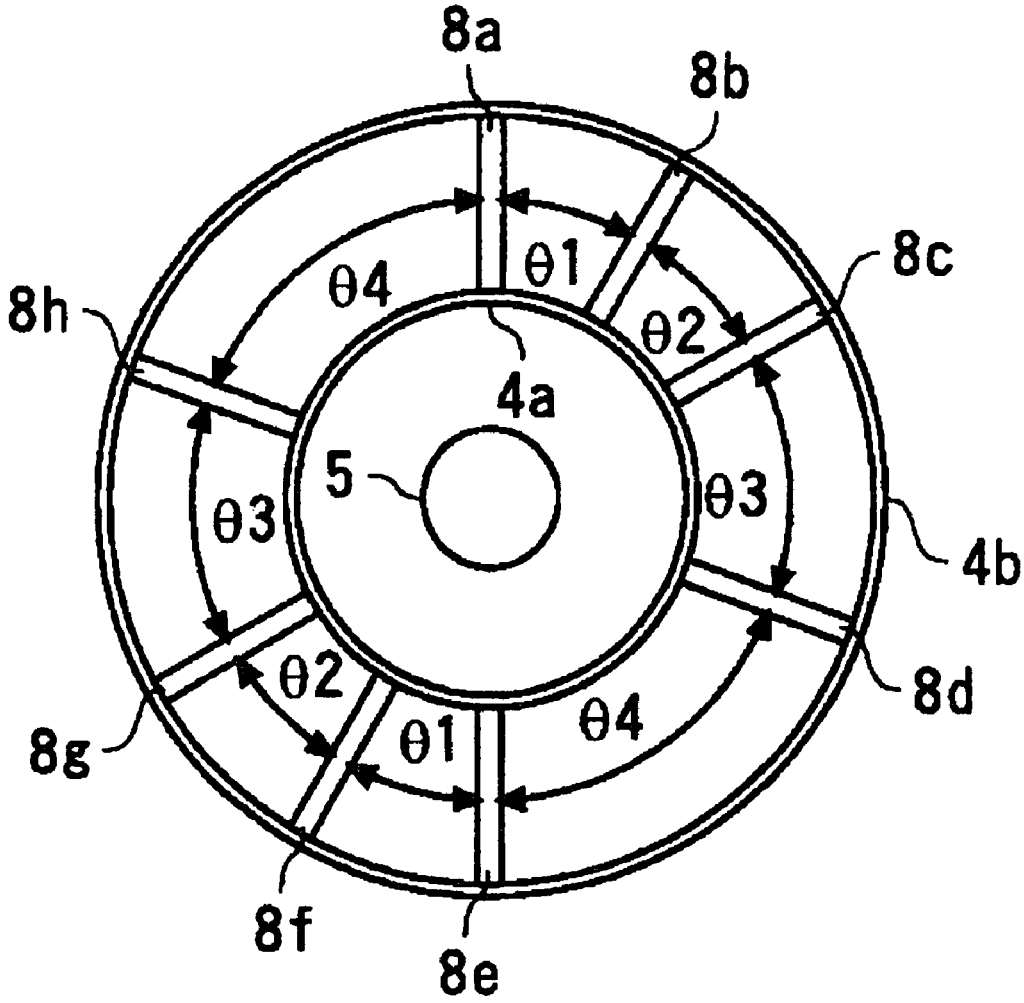
FIG. 5 is a drawing that shows another example of the arrangement relationship of struts in the intake duct of the first embodiment.

In this way, in the present embodiment, as shown in the frequency component distribution of the total pressure of the air that flows into the downstream of the struts 8 in (b) of FIG. 4, due to being capable of reducing the harmonic component, it is possible to increase the design degree of freedom with respect to the installation position of the stator blade 11 and the rotor blade 12 of the compressor 1. Note that regarding the positional relation in the circumferential direction of the struts 8, FIG. 3 is only one example, and for the eight struts 8*a* to 8*h*, the angle of adjacent spacing of one portion may be at least 15 degrees (=120/8 degrees), in which angles θ1, θ2 are 30 degrees, angle θ3 is 50 degrees, and angle θ4 is 70 degrees as shown in FIG. 5.

Furthermore, regarding the number of the struts 8, it is not limited to eight, and so long as a number is provided that is capable of sufficiently supporting the inner casing 4*a* and the outer casing 4*b*, it may be more than or less than eight. Note that since a pressure drop occurs due to the wake generated by the struts 8 as described above, it is preferable for the number of the struts 8 to be as few as possible in order to reduce the pressure drop of the air that is flowed into the compressor 1.

(Second Embodiment)

Figure 6:
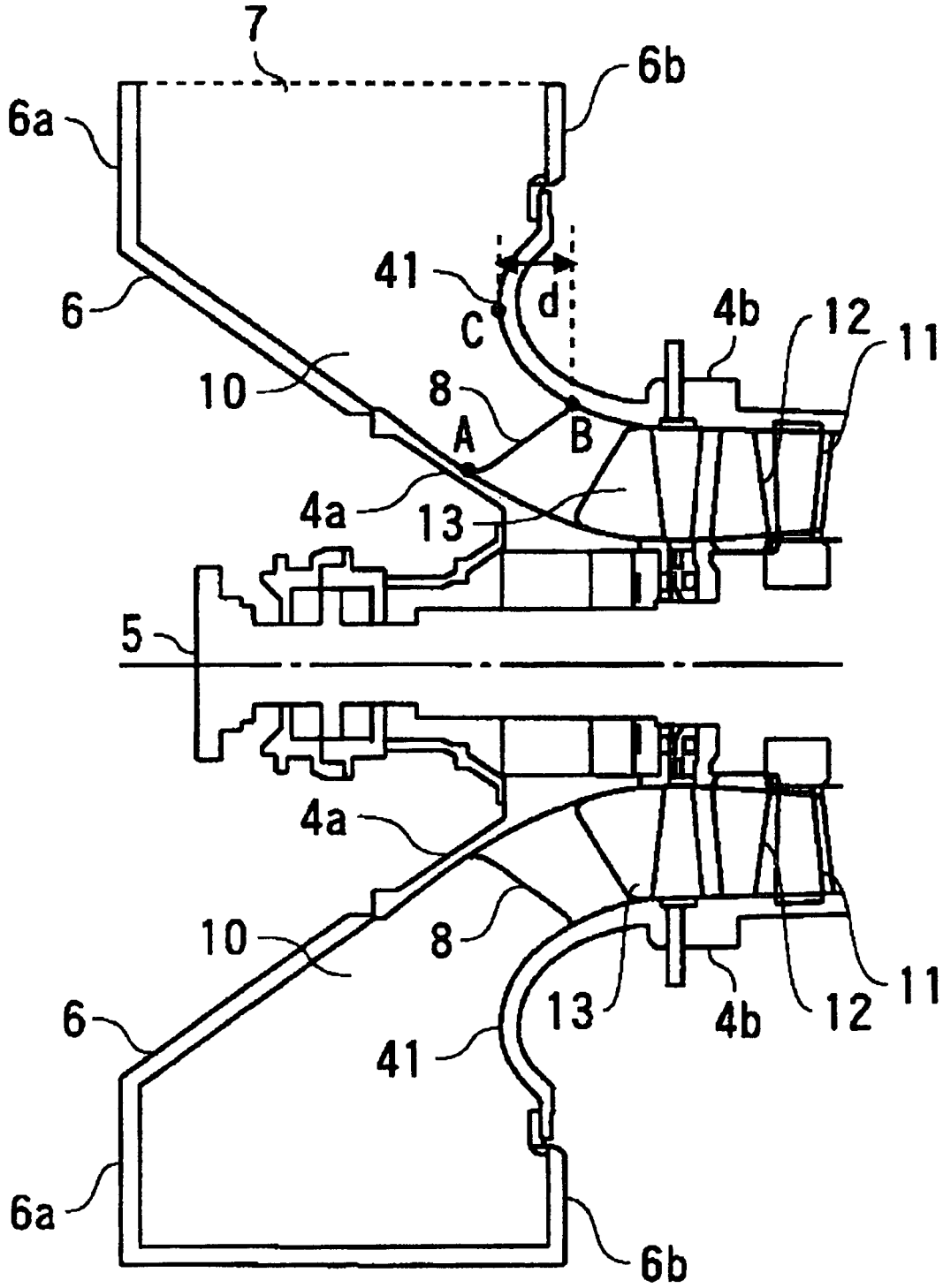
FIG. 6 is an outline sectional view around an intake duct showing the constitution of an intake duct of a second embodiment.

The second embodiment of the compressor of the present invention shall be described with reference to the appended drawings. FIG. 6 is an outline sectional view that shows the constitution around the intake duct of the compressor of the present embodiment. Those portions that are the same as the constitution of FIG. 2 are denoted by the same reference numerals, and so a detailed description thereof shall be omitted.

In the present embodiment, as shown in FIG. 6, in contrast to the constitution shown in FIG. 2, the strut 8 has a shape that, heading toward the periphery of the rotor shaft 5, slopes to the downstream in the axial direction of the rotor shaft 5 so that the connection position A of the strut 8 at the inner casing 4*a* is further upstream compared to the connection position B at the outer casing 4*b*. By constituting the strut 8 in this way, a distance d from the distal end of the curved portion 41 of the outer casing 4*b* to the connection position B of the strut 8 at the outer casing 4*b* becomes longer compared to the case of the constitution of FIG. 2.

Now, due to the curved portion 41 of the outer casing 4*b* having a bell mouth shape, air that flows from the periphery along the inner wall of the intake casing 6*b* of the compressor 1 side of the intake duct 6 flows until the entrance of the air flow path 13 where the strut 8 is installed without the flow coming to a rest. For that reason, a difference in the flow velocity of air that flows in occurs between the inner casing 4*a* side and the outer casing 4*b* side at the entrance of the air flow path 13.

However, by making the shape of the strut 8 slope toward the trailing edge (the downstream in the axial direction of the rotor shaft 5) as in FIG. 6, it is possible to lengthen the distance from the entrance of the air flow path 13 to the strut 8, heading from the inner casing 4*a* side to the outer casing 4*b*. Therefore, it is possible to put the flow velocity distribution of air at the leading edge of the strut 8 (the edge at the upstream in the axial direction of the rotor shaft 5) in an approximately equivalent state. Thereby, it is possible to make the flow of air that flows into the strut 8 a more uniform flow, and it is possible to reduce pressure loss at the side of the connection position with the outer casing 4*b* (the tip side).

Note that in FIG. 6, in the plurality of the struts 8 arranged in the circumferential direction of the rotor shaft 5, the connection position B with the outer casing 4*b* is positioned further to the downstream compared to the connection position A with the inner casing 4*a*. Accordingly, in the plurality of the struts 8, the distance d from the distal end C of the curved portion 41 of the outer casing 4*b* to the connection position B is the same. However, for a strut 8*a* positioned near the suction port 7 and a strut 8*d* positioned far from the suction port 7, when comparing distances d1, d4 from the distal end C of the curved portion 41 of the outer casing 4*b* to the connection position B with the outer casing 4*b*, as shown in FIG. 7, the distance d1 may be made longer than the distance d4.

Figure 7:
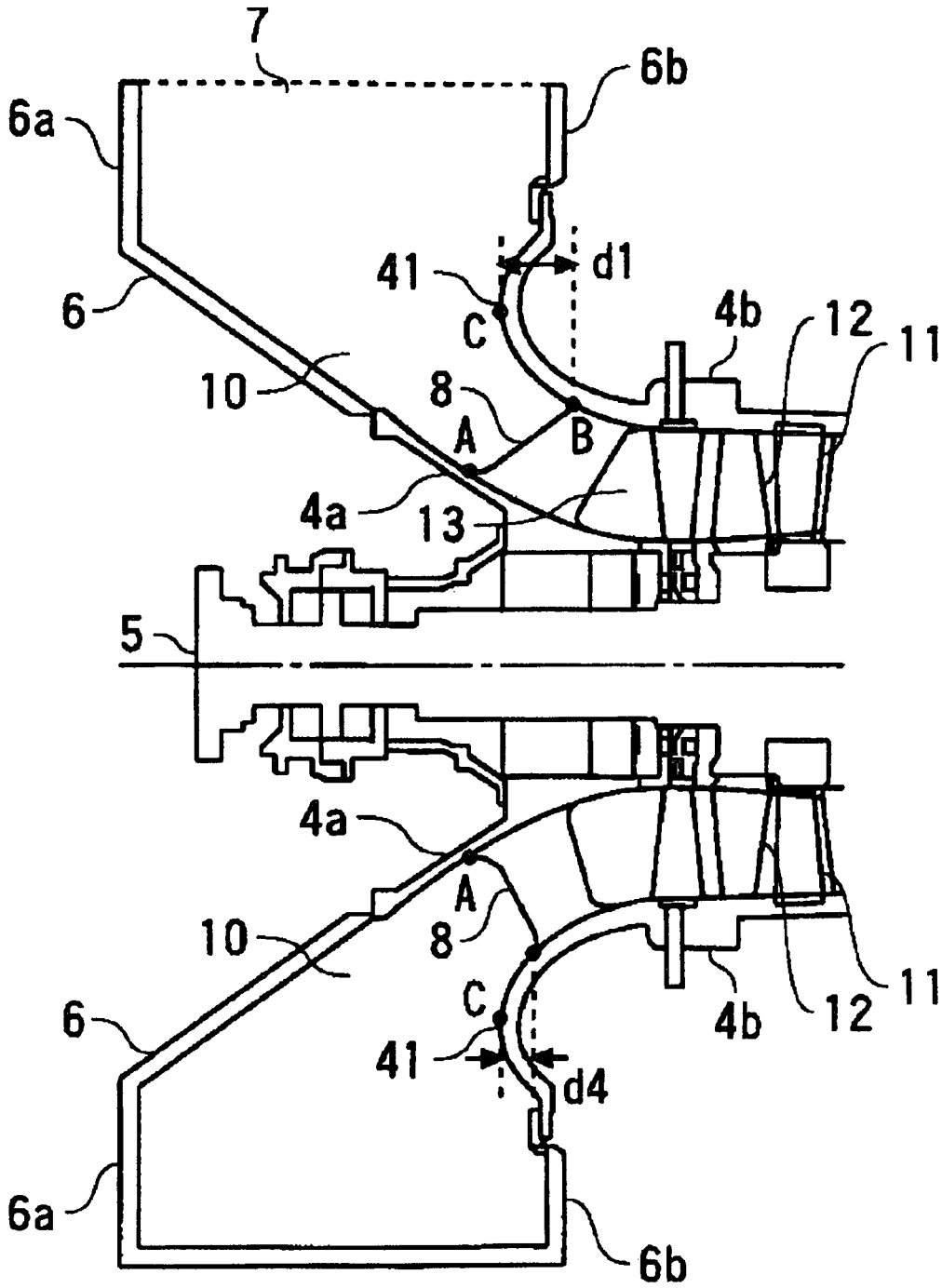
FIG. 7 is an outline sectional view around an intake duct showing another constitution of the intake duct of the second embodiment.
Figure 8:
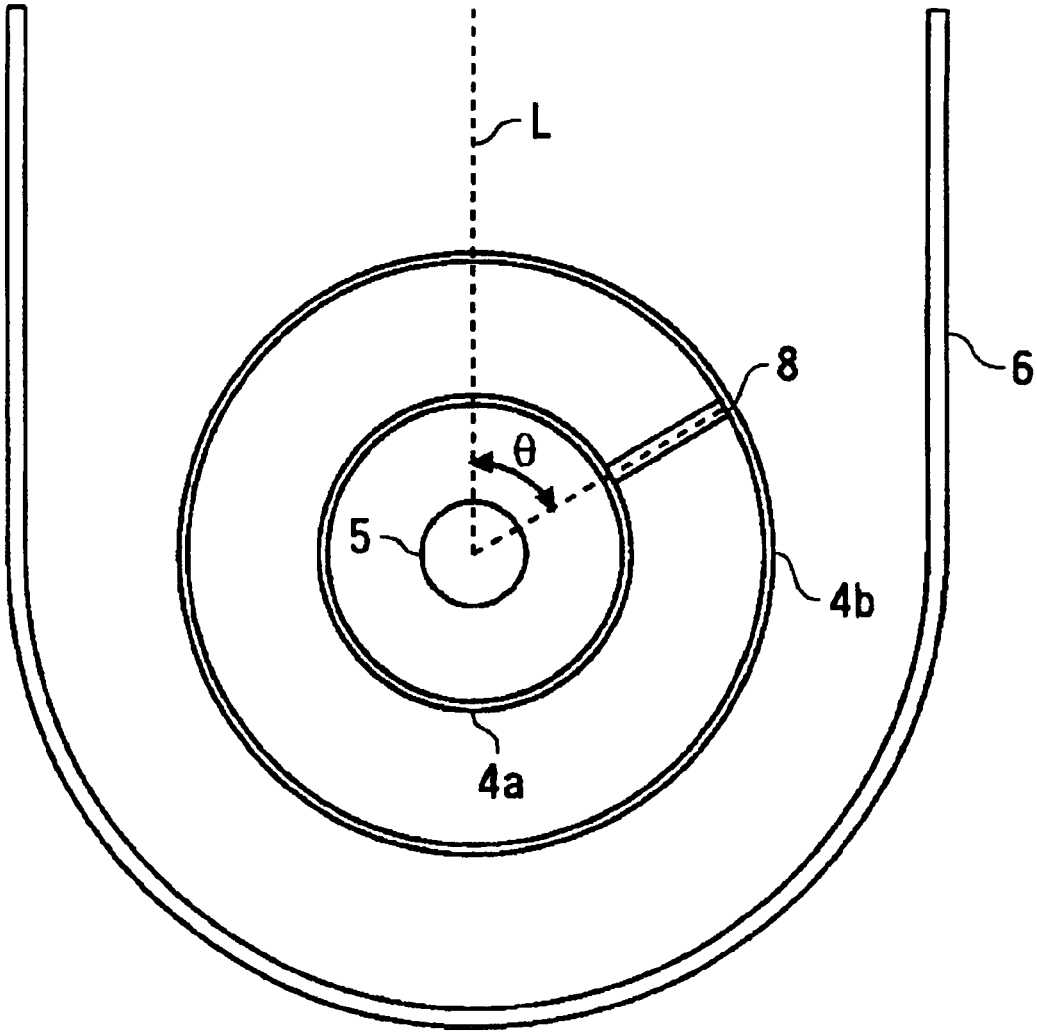
FIG. 8 explains the positional relationship of the strut and the rotor shaft.

Furthermore, as shown in FIG. 7, when changing the distance d from the distal end C of the curved portion 41 of the outer casing 4*b* to the connection position B with the outer casing 4*b* depending on the position in the circumferential direction of the strut 8, the distance d is changed in accordance with an intersection angle θ (0 degrees ≦θ≦180 degrees, refer to FIG. 8) with a straight line L that connects the center of the suction port 7 and the center of the rotor shaft 5, the distance d may decrease the further it moves away from the suction port 7 due to the increase in the intersection angle θ.

Also, regarding the positional relation in the circumferential direction of the struts 8, by making the spacings of adjacent struts 8 unequal as in the first embodiment (for example, refer to FIG. 3 and FIG. 5), the harmonic component in the frequency component distribution of the total pressure of the air that flows in to the downstream of the strut 8 may be reduced, and the degree of freedom in the blade design of the compressor 1 may be increased.

(Third Embodiment)

Figure 9:
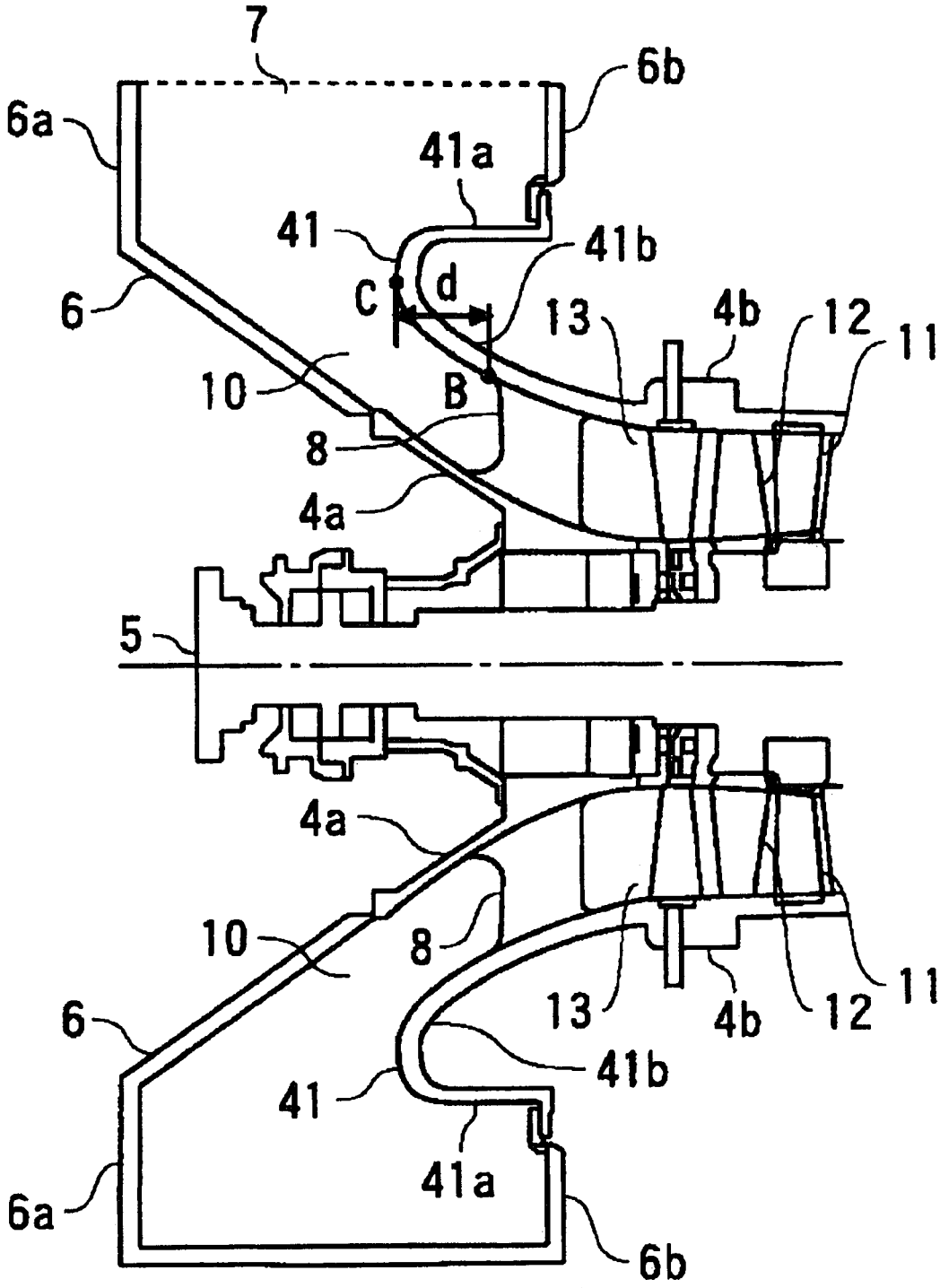
FIG. 9 is an outline sectional view around the intake duct showing the constitution of an intake duct of a third embodiment.

The third embodiment of the compressor of the present invention shall be described with reference to the appended drawings. FIG. 9 is an outline sectional view that shows the constitution around the intake duct of the compressor of the present embodiment. Those portions that are the same as the constitution of FIG. 2 are denoted by the same reference numerals, and so a detailed description thereof shall be omitted.

In the present embodiment, in contrast to the constitution shown in FIG. 2, as shown in FIG. 9, the curved portion 41 of the outer casing 4*b* has a constitution of projecting further to the side of the intake casing 6*a*. Accordingly, in the periphery side of the curved portion 41, a flat portion 41*a* is formed that becomes a surface that is approximately parallel with the peripheral surface of the rotor shaft 5 (a surface approximately perpendicular to the intake casing 6*b*). Thus a cross section of the flat portion 41*a* from the distal end of the intake casing 6*a* side toward the inner side thereof forms a curved surface portion 41*b* having a U-shape in which the distal end thereof faces the side of the intake casing 6*a*.

In this way, by providing the flat portion 41*a* in the curved portion 41 that is connected with the intake casing 6*b* of the outer casing 4*b*, it is possible to stop the flow of air that flows in from the periphery side along the inner wall of the intake casing 6*b*. At this time, since it is possible to cause the flow of this air to turn in the circumferential direction by this flat portion 41*a*, it is possible to accelerate the flow of air that flows along the curved surface portion 41*b* from the flat portion 41*a* of the curved portion 41 from nearly the same condition in the circumferential direction. Thereby, it is possible to put the distribution of the flow of air that flows into the air flow path 13 in an approximately equivalent state with respect to the circumferential direction of the rotor shaft 5 and moderate drifts.

Also, due to the constitution that provides the flat portion 41*a* in the curved portion 41 so as to project toward the intake casing 6*a*, it is possible to lengthen the distance d from the distal end C of the curved portion 41 to the connection position B of the strut 8 with the outer casing 4*b*. Thereby, similarly to the second embodiment, it is possible to make the flow of air that flows into the strut 8 a more uniform flow, and it is possible to reduce pressure loss at the side of the connection position with the outer casing 4*b* (the tip side).

Therefore, in the present embodiment, the flat portion 41*a* is provided in the curved portion 41 so as to project into the intake duct 6. Since it is possible to put the distribution of the flow of air that flows into the air flow path 13 into a state of being approximately even with respect to the radial direction and circumferential direction of the rotor shaft 5 and reduce drifts, it is possible to suppress a drop in efficiency of the compressor.

Figure 10:
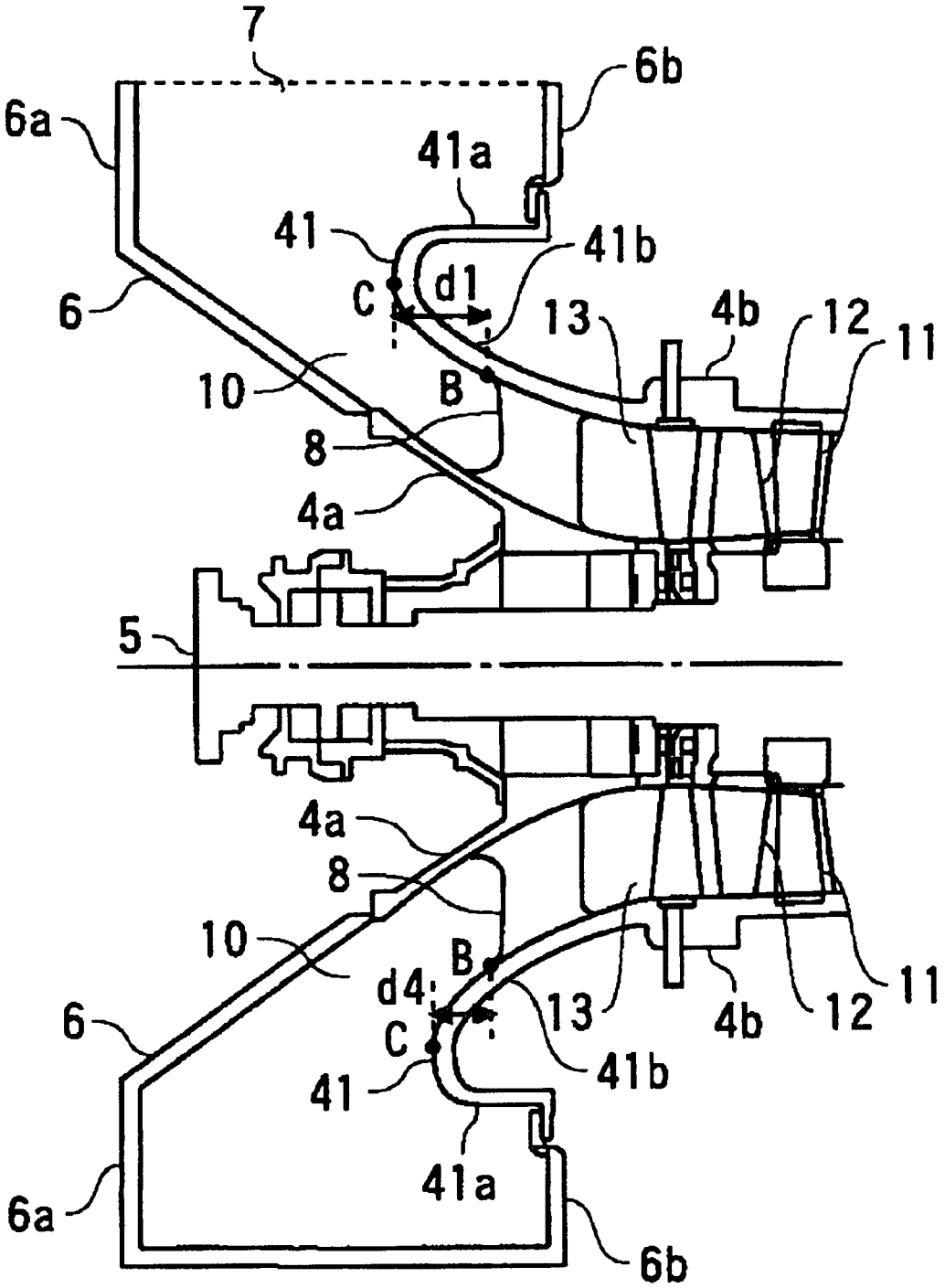
FIG. 10 is an outline sectional view around an intake duct showing another constitution of the intake duct of the third embodiment.
Figure 11:
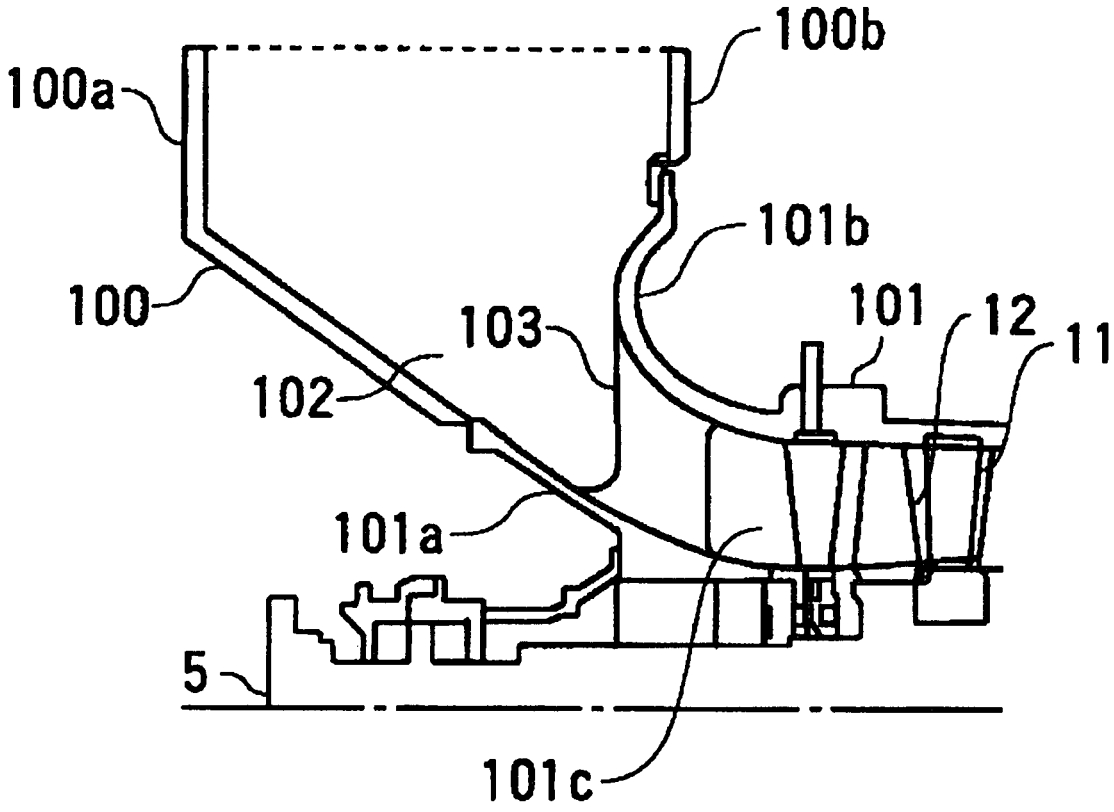
FIG. 11 is an outline sectional view around the intake duct showing the constitution of a conventional intake duct.
Figure 12:
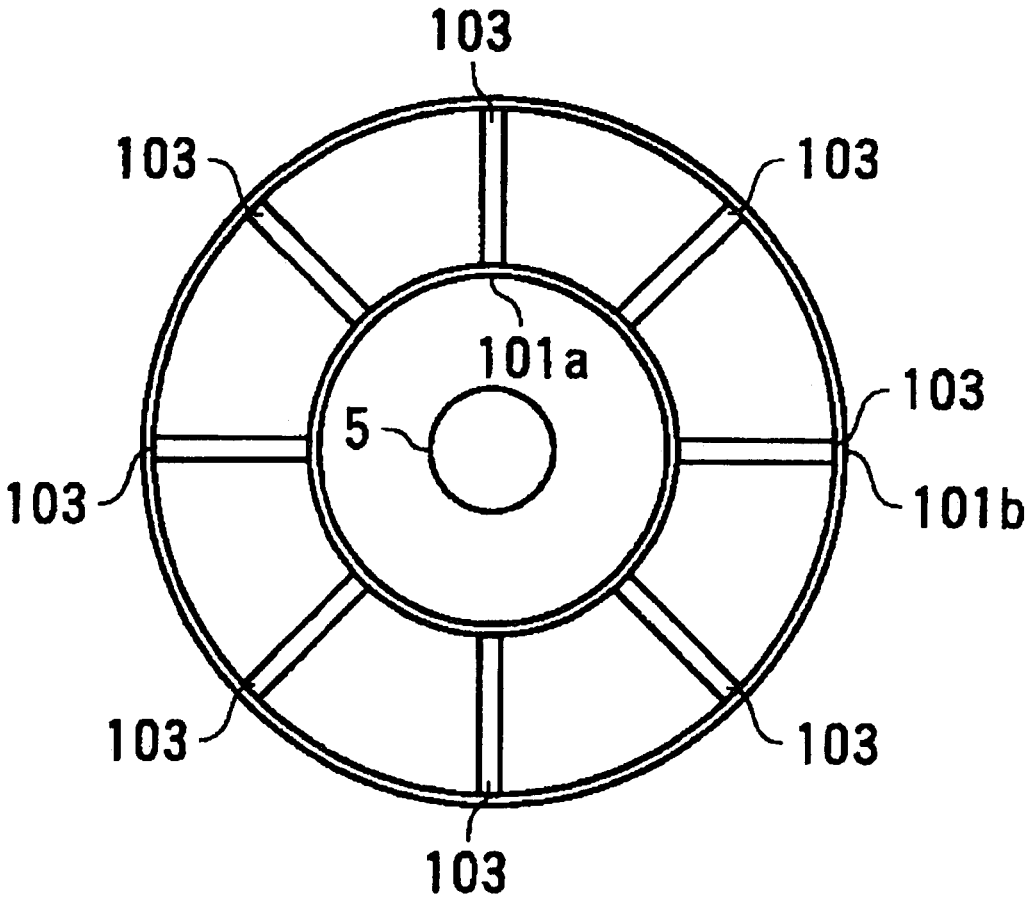
FIG. 12 shows the arrangement relationship of struts in the convention intake duct.

Note that in FIG. 9, the curved portion 41 of the outer casing 4*b* is made to have the same cross-sectional shape with respect to the circumferential direction of the rotor shaft 5. But as shown in FIG. 10, the length in the axial direction of the flat portion 41*a* at a position near the suction port 7 may be made to become longer than the length in the axial direction of the flat portion 41*a* at a potion far from the suction port 7. By doing so, for a strut 8*a* positioned near the suction port 7 and a strut 8*d* positioned far from the suction port 7, when comparing distances dl, d4 from the distal end C of the curved portion 41 of the outer casing 4*b* to the connection position B with the outer casing 4*b*, as shown in FIG. 10, the distance d1 becomes longer than the distance d4. Note that the position that is far from the suction port 7 may be made into the same bell mouth shape as in FIG. 2 without the flat portion 41 a being constituted in the curved portion 41.

Moreover, when producing the constitution as shown in FIG. 10, when changing the distance d from the distal end C of the curved portion 41 of the outer casing 4*b* to the connection position B with the outer casing 4*b* depending on the position in the circumferential direction of the curved portion 41, it may be arranged in the following manner. The distance d is changed in accordance with the intersection angle θ (0 degrees≦θ≦180 degrees, refer to FIG. 8) with a straight line L that connects the center of the suction port 7 and the center of the rotor shaft 5, and the distance d may increase the further it moves away from the suction port 7 due to the increase in the intersection angle θ.

Note that in the present embodiment, regarding the positional relation in the circumferential direction of the struts 8, by making the spacings of adjacent struts 8 unequal as in the first embodiment (for example, refer to FIG. 3 and FIG. 5), the harmonic component in the frequency component distribution of the total pressures of the air that flows in to the downstream of the strut 8 may be reduced, and the degree of freedom in the blade design of the compressor 1 may be increased. Also, as in the second embodiment, the flow velocity distribution of air at the leading edge of the strut 8 may be put in an approximately equivalent state by the connection position B of the strut 8 with the outer casing 4*b* being positioned further downstream compared to the connection position A thereof with the inner casing 4*a*.

[Industrial Applicability]

The compressor of the present invention can be applied to a compressor having a single suction structure provided with an annular space centered on a rotor shaft and with a suction port opened at one side. Also, it may be applied to a compressor that is constituted to have the same axis as a gas turbine that is rotationally driven by combustion gas.

The invention claimed is:

1. A compressor comprising:

an inner casing arranged to cover a rotor shaft;

an outer casing arranged to cover the inner casing and forming a fluid flow path around the rotor shaft; and a plurality of struts mounted in the entrance of the fluid flow path and between the inner casing and the outer casing, wherein the plurality of struts are arranged in a radial pattern centered on the rotor shaft, and the spacings between the adjacent struts in the circumferential direction of the rotor shaft are unequal;

a first casing connected to the inner casing at the entrance end of the fluid flow path;

a second casing connected to the outer casing at the entrance end of the fluid flow path, wherein a curved portion that curves to project toward the first casing is formed at the connection portion of the outer casing with the second casing;

a flat portion that is adjacent to the second casing and consists of a surface that is approximately parallel with the peripheral surface of the rotor shaft;

a curved surface that smoothly curves inward in the radial direction of the rotor shaft from the distal end of the flat portion;

a cross-section of the curved portion forms an approximate U-shape that projects toward the first casing;

the connection portions of the struts with the outer casing are positioned further to the downstream in the axial direction of the rotor shaft than the distal end of the curved portion; and in the flat portion that is formed in an annular shape along the circumferential direction of the rotor shaft, the length in the axial direction of a portion adjacent to an open air suction port that is formed at the distal end of the first casing and the second casing is longer than the length in the axial direction of another portion that is positioned further from the suction port than the portion.

2. The compressor according to claim 1, wherein n struts are arranged in the circumferential direction of the rotor shaft (n being an integer of 2 or more); and the difference between the maximum value and the minimum value of the angle expressing the spacings of the adjacent struts when centered on the rotor shaft is at least 120 degrees/n.

3. The compressor according to claim 1, wherein the connection portions of the struts with the outer casing are positioned further to the downstream in the axial direction of the rotor shaft than the distal end of the curved portion.

4. The compressor according to claim 1, wherein in the curved portion that is formed in an annular shape along the circumferential direction of the rotor shaft, the distal end of a portion that is adjacent to an open air suction port that is formed at the distal end of the first casing and the second casing projects further toward the first casing than the distal end of another portion that is positioned further from the suction port than the portion.

5. The compressor according to claim 1, wherein the connection portions of the struts with the outer casing are positioned further downstream in the axial direction of the rotor shaft than the connection portions of the struts with the inner casing.

6. The compressor according to claim 5, wherein the distance in the axial direction of the connection portion between the struts with the outer casing and the distance in the axial direction of the connection portion between the struts with the inner casing are longer the closer the struts are to the suction port.

7. The compressor according to claim 3, wherein in the curved portion formed in an annular shape along the circumferential direction of the rotor shaft, the distal end of a portion that is adjacent to an open air suction port formed at the distal end of the first casing and the second casing projects further toward the first casing than the distal end of another portion that is positioned further from the suction port than the portion.

8. The compressor according to claim 3, wherein the connection portions of the struts with the outer casing are positioned further downstream in the axial direction of the rotor shaft than the connection portions of the struts with the inner casing.

9. The compressor according to claim 4, wherein the connection portions of the struts with the outer casing are positioned further downstream in the axial direction of the rotor shaft than the connection portions of the struts with the inner casing.

10. The compressor according to claim 7, wherein the connection portions of the struts with the outer casing are positioned further downstream in the axial direction of the rotor shaft than the connection portions of the struts with the inner casing.

11. The compressor according to claim 8, wherein the distance in the axial direction of the connection portion between the struts with the outer casing and the distance in the axial direction of the connection portion between the struts with the inner casing are longer the closer the struts are to the suction port.

12. The compressor according to claim 9, wherein the distance in the axial direction of the connection portion between the struts with the outer casing and the distance in the axial direction of the connection portion between the struts with the inner casing are longer the closer the struts are to the suction port.

13. The compressor according to claim 10, wherein the distance in the axial direction of the connection portion between the struts with the outer casing and the distance in the axial direction of the connection portion between the struts with the inner casing are longer the closer the struts are to the suction port.

* * * * *